US005441084A

United States Patent [19]

Corain et al.

[11] Patent Number: 5,441,084

[45] Date of Patent: Aug. 15, 1995

[54] SYSTEM FOR MAINTAINING A CONSTANT TERRY LOOP HEIGHT IN TERRY CLOTH DURING REVERSE MOVEMENT OF THE TERRY LOOM

[75] Inventors: Luciano Corain; Ruggero Manzardo; Vittorio Apolloni, all of Venice, Italy

[73] Assignee: Nuovopignone - Industrie Meccaniche E Fonderia S.p.A., Florence, Italy

[21] Appl. No.: 193,870

[22] Filed: Feb. 9, 1994

[30] Foreign Application Priority Data

Feb. 11, 1993 [IT] Italy ..... MI93A0235

[51] Int. Cl.[6] ..... D03D 39/22; D03D 49/10

[52] U.S. Cl. ..... 139/25; 139/102

[58] Field of Search ..... 139/25, 102, 27

[56] References Cited

U.S. PATENT DOCUMENTS 4,554,951 11/1985 Hirano et al. .

4,569,373 2/1986 Vogel ..... 139/25

4,974,639 12/1990 Maitan et al. ..... 139/25 X 5,002,095 3/1991 Herrin et al. ..... 139/25

FOREIGN PATENT DOCUMENTS 0578079 1/1994 European Pat. Off. .

*Primary Examiner*—Andrew M. Falik

*Attorney, Agent, or Firm*—Oblon, Spivak, McClelland, Maier, & Neustadt

[57] ABSTRACT

A system for maintaining a constant terry height in forming a terry cloth despite loom stoppage, e.g., to correct yarn breakage. The system includes a proximity sensor which is positioned at a predetermined distance from a floating roller, and on the same side of the floating roller as a loading spring. The proximity sensor causes stoppage of an electric motor of the feed beam for the terry warp yarns which were previously driven in a forward direction by the electric control center. Upon sensing movement of the floating roller by a predetermined distance, the electrical control sensor causes motion inversion of the electric motor to reverse the movement of the feed beam for the terry warp yarns.

2 Claims, 1 Drawing Sheet

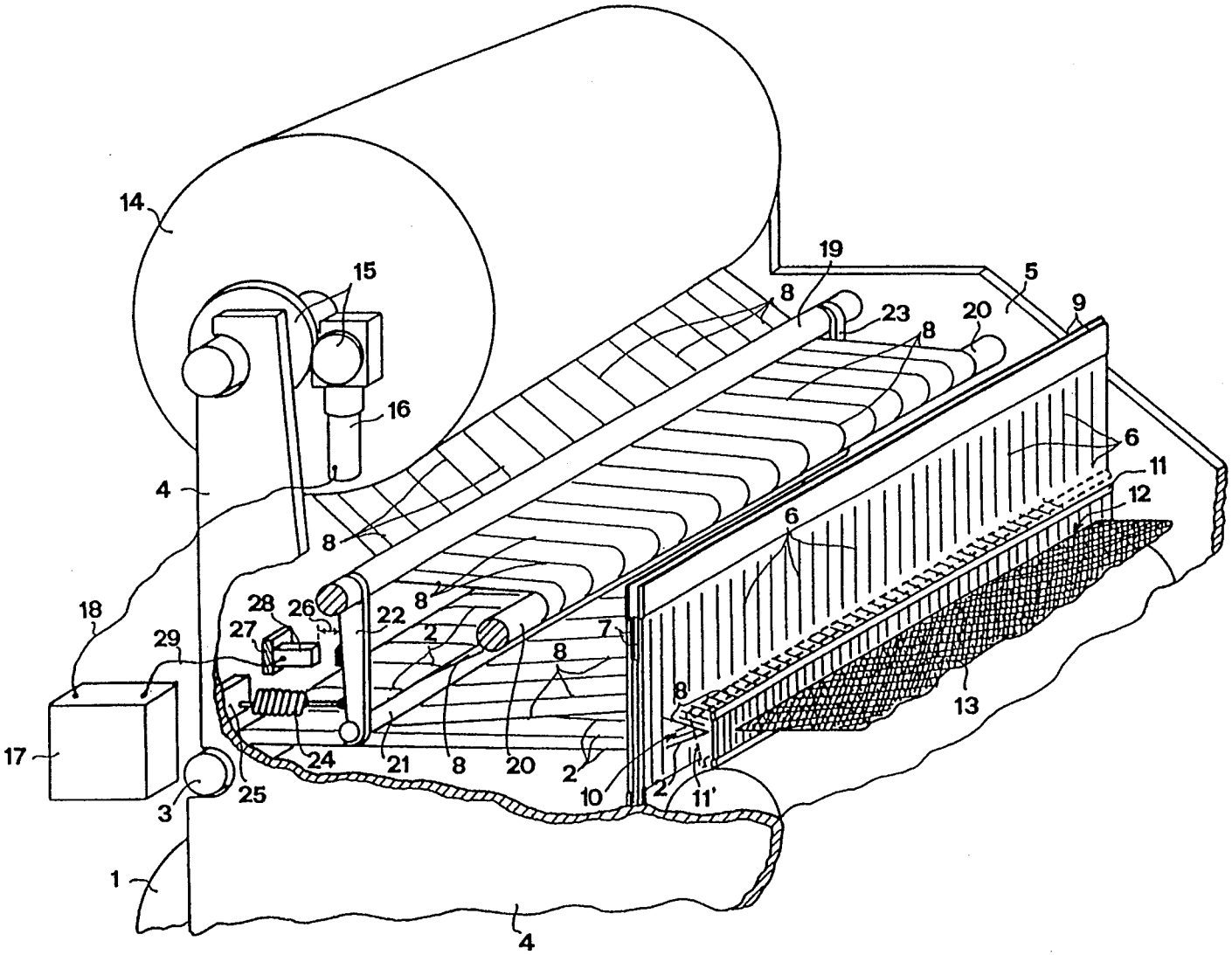
1
2
3
4
5
6
7
8
9
10
11
11'
12
13
14
15
16
17
18
19
20
21
22
23
24
25
26
27
28
29

SYSTEM FOR MAINTAINING A CONSTANT TERRY LOOP HEIGHT IN TERRY CLOTH DURING REVERSE MOVEMENT OF THE TERRY LOOM

BACKGROUND OF THE INVENTION

1. Field of the Invention

This invention relates to a system which by allowing the warp yarn tension to be suitably slackened during reverse movement of the terry loom, hence preventing any alteration in the terry height of the cloth under formation, enables defect-free terry cloth to be obtained.

DISCUSSION OF BACKGROUND

As is well known from our italian patent application No. 30194 A/75 filed on Dec. 11, 1975 and which has a U.S. counterpart, Pat. No. 4,099,546, the characteristic terry of terry cloth is formed by making the reed, rigid with the loom sley, beat against the edge of the cloth under formation after two or more weft yarns have been inserted. In other words, one or more weft yarns are inserted into tile successive sheds formed by a series of so-called "base or taut" warp yarns and a corresponding series of so-called "slow OF terry." warp yarns, and are simply carried by the reed into a position rearward of the edge of the cloth under formation, ie in proximity to the edge but without being beaten against it. Only after the next weft yarn has been inserted into the respective shed does the reed beat all these inserted yarns against the edge of the cloth under formation, to thereby determine a curling of the slow of terry warp yarns.

The terry height evidently depends on the more or less rearward position in which the reed groups the inserted weft yarns before beating them against the edge of the cloth under formation.

Again, although the terry warp yarns must be "slow", ie subjected to a tension considerably less than that to which the base warp yarns are subjected, they must however undergo a constant average tensioning, which is generally achieved by a spring-loaded floating roller about which the terry warp yarns originating from the feed beam pass. This not only compensates variations in the terry warp yarns, but also accommodates for the requirement for a greater warp yarn length deriving from the fact that the weft yarns are beaten by the reed right up against the edge of the cloth under formation.

It has however been round that every time the loom is reversed to correct any yarn breakage, a defective cloth is inevitably obtained because the terry height on the cloth is no longer perfectly uniform.

The observed reason for this is that substantially the height of the last terry formed before loom stoppage is in practice reduced or even annulled by the pull exerted by the feed beam during reversing.

SUMMARY OF THE INVENTION

The object of the present invention is precisely to obviate the above drawback by providing a system which prevents any terry height reduction, hence maintaining the cloth terry height constant during reverse movement of the terry loom.

This is substantially attained in that, before commencing reverse movement, the beam for the terry warp yarns is further rotated forwards to unwind a length of warp yarn equal to that which the beam takes up during the reverse movement, so that this take-up of warp yarn by the beam during reverse movement is not at the expense of the last terry formed, On the other hand, although the length of warp yarn to be unwound is substantially the same for a given yarn, it is however unclear how far to rotate the beam to unwind the length because a nearly empty beam would require to be rotated through a greater distance than a full beam. To overcome this difficulty the invention utilizes the fact that the spring-loaded floating roller is always sensitive to tension variations such as that which occurs on unwinding the length of warp yarn. For this purpose a proximity sensor is used which, by acting substantially as a limit switch, detects when the floating roller reaches a certain predetermined distance from it, after a rotary movement equal to the length of warp yarn, to halt the drive motor of the beam feeding the terry warp yarns and then to invert its motion (reverse movement).

Hence, the system for maintaining a constant terry height on terry cloth during reverse movement of a terry loom includes a feed beam for the base warp yarns, a feed beam for the terry warp yarns rotated by an electric motor, an electrical control center for controlling, inter alia, the electric motor, a spring-loaded floating roller for compensating the tension in the terry warp yarns and a reed for weft beat-up in two positions. The system according to the present invention is characterized by a proximity sensor positioned spaced from the floating roller, on the same side as the loading spring thereof, by a distance equal to the length of warp yarn which the terry beam takes up during reverse movement. The sensor is connected, via the electrical control center so as to cause stoppage of the electric motor previously driven in a forward direction by the electrical control center, and immediately afterwards causes motion inversion of the motor for the reverse movement.

BRIEF DESCRIPTION OF THE DRAWINGS

The invention is further clarified hereinafter with reference to the accompanying drawing which illustrates a preferred embodiment thereof given by way of non-limiting example only, in that technical or constructional modifications can be made thereto without departing from the scope of protection of the present invention. In the drawing, the figure represents a partial perspective view of a terry loom using the system for maintaining a constant terry height on the terry cloth during loom reverse movement, according to the invention.

DETAILED DESCRIPTION OF THE PREFERRED EMBODIMENTS

In the figure, the reference numeral 1 indicates the feed beam for the base warp yarns 2 which rotate about the yarn support roller 3 supported by the loom sides 4 and 5 to pass through the eyes of tile heddles 6 of the loom heddle frames 7, to form with the terry warp yarns 8, which also pass through the eyes of the heddles 6 of the loom heddle frames 9, the shed 10 into which there are inserted the weft yarns, these being either carried by the reed 11 into the rearward position indicated by the dashed line 11' in the figure, or are beaten against the edge 12 of the cloth under formation, to form the terry cloth 13.

The terry warp yarns 8 are fed by the overlying beam 14 which is rotatably supported by the loom sides 4 and 5 and is rotated, via a reduction gear 15, by an electric motor 16 controlled by an electrical control center 17 via the cable 18.

The warp yarns 8 leave the beam 14 to pass about a deviator roller 19 fixedly supported by the loom sides 4 and 5, and then about a second deviator roller 20 to also fixedly supported by the loom sides 4 and 5, to finally pass about a floating roller 21 before reaching the heddle frames 9.

Said floating roller 21 is pivoted on the deviator roller 19 via lateral support bars 22 and 23 and is loaded by springs 24 acting between the support bars 22 and 23 and brackets 25 rigid with the loom sides 4 and 5 (only one spring 24 and one bracket 25 are visible in the figure, the others being on the other side), to exert and maintain substantially unvaried a slight pressure on the terry warp yarns 8, as is clear from the figure.

At a certain distance 26 from that side of the lateral support bar 22 corresponding to the spring there is mounted, on a bracket 27 rigid with the loom side 4, a proximity sensor 28 connected to the electrical control center 17 by the cable 29. The distance 26 is made equal to the length of warp yarn which the beam 14 takes up during reverse movement.

The operation of the system should be readily apparent in view of the foregoing and as follows.

At each loom stoppage due to yarn breakage or another reason, the control center 17 causes the motor 16 to rotate the beam 14 in the direction for unwinding warp yarn 8, ie in the anticlockwise direction with reference to the figure; this evidently results in a reduction in tension of the warp yarns 8, leading by the effect of the springs 24 to an anticlockwise rotation of the floating roller 21 through a distance equal to the distance 26 corresponding to the delivery of a length of warp yarn 8 by the beam 14 precisely equal to that which the beam 14 takes up during reverse movement. In this respect, on termination of the movement 26 the proximity sensor 28 acts to firstly cause stoppage of the beam 14 followed by inversion of its motion for the reverse movement, which therefore takes place only at the expense of the warp yarn 8 which has just been unwound and no longer at the expense of the last terry formed.

We claim:

1. A system for maintaining a constant terry height in terry cloth during reverse movement of a terry loom following a loom stoppage comprising:

a first beam for feeding base warp yarns, a second beam for feeding terry warp yarns rotated by an electric motor, an electrical control center for controlling said electric motor to rotate said second beam in a forward direction to feed said terry warp yarns a specified amount after said loom stoppage, a spring loaded-floating roller for maintaining tension in said terry warp yarns and adapted to be attached to said loom by a loading spring fastened to one side of said roller, and a reed for a weft beat-up in two positions;

the system further including a proximity sensor positioned at a location spaced from said spring-loaded floating roller, said proximity sensor disposed on the same side of said spring-loaded floating roller as the losing spring thereof, with said proximity sensor spaced from said spring-loaded floating roller by a distance equal to a length of warp yarn which the second beam takes up during a reverse movement;

said sensor being connected to said electrical control center so that upon detection of the floating roller it causes said control center to first stop the electric motor and said second beam previously driven in said forward direction and then immediately afterwards to reverse both the motor and the beam directions;

whereby upon said loom stoppage the electric motor drives said second beam in the forward direction such that said spring-loaded floating roller moves said distance to be detected by said proximity sensor and thereafter during said reverse movement the amount of terry warp yarn taken up by said second beam is limited to said specified amount fed as said spring-loaded floating roller is moved said distance.

2. A system for maintaining a constant terry height in terry cloth during reverse movement of a terry loom following a loom stoppage comprising:

a first beam for feeding base warp yarns, a second beam for feeding terry warp yarns rotated by an electric motor, an electrical control center for controlling said electric motor to rotate said second beam in a forward direction to feed said terry warp yarns a specified amount after said loom stoppage, a spring loaded-floating roller for maintaining tension in said terry warp yarns, and a reed for a weft beat-up in two positions;

the system further including sensing means for sensing movement of said spring loaded floating roller with said sensing means spaced from said spring-loaded floating roller by a distance equal to a length of warp yarn which the second beam takes up during a reverse movement;

said sensing means being connected to said electrical control center so that upon detection of the floating roller it causes said control center to first stop the electric motor and said second beam previously driven in said forward direction and then to reverse both the motor and the beam directions;

whereby upon said loom stoppage the electric motor drives said second beam in the forward direction such that said spring-loaded floating roller moves said distance to be detected by said proximity sensor and thereafter during said reverse movement the amount of terry warp yarn taken up by said second beam is limited to said specified amount fed as said spring-loaded floating roller is moved said distance.

* * * * *

UNITED STATES PATENT AND TRADEMARK OFFICE

CERTIFICATE OF CORRECTION

PATENT NO. : 5,441,084

DATED : August 15, 1995

INVENTOR(S) : Luciano CORAIN, et al.

It is certified that error appears in the above-indentified patent and that said Letters Patent is hereby corrected as shown below:

On the title page, Item [75], the city of residence of the three inventors should read:

--Vicenza--

Signed and Sealed this

Thirty-first Day of October 1995

*Attest:*

*Attesting Officer*

Bruce Lehman

BRUCE LEHMAN

*Commissioner of Patents and Trademarks*